166-308 SR
4/28/87 XR 4,660,643

United States Patent [19]
Perkins

[11] Patent Number: 4,660,643
[45] Date of Patent: Apr. 28, 1987

[54] COLD FLUID HYDRAULIC FRACTURING PROCESS FOR MINERAL BEARING FORMATIONS

[75] Inventor: Thomas K. Perkins, Dallas, Tex.

[73] Assignee: Atlantic Richfield Company, Los Angeles, Calif.

[21] Appl. No.: 829,374

[22] Filed: Feb. 13, 1986

[51] Int. Cl.[4] ..... E21B 36/00; E21B 43/26; E21B 43/267

[52] U.S. Cl. ..... 166/283; 166/302; 166/308

[58] Field of Search ..... 166/308, 283, 302, 281

[56] References Cited

U.S. PATENT DOCUMENTS

| | | | |
|---|---|---|---|
| 3,323,594 | 6/1967 | Huitt et al. | 166/308 |
| 3,405,062 | 10/1968 | Kuhn | 166/283 X |
| 4,109,721 | 8/1978 | Slusser | 166/308 X |
| 4,476,932 | 10/1984 | Emery | 166/308 X |

OTHER PUBLICATIONS

*Oil and Gas Journal Tech-Report,* Reprint of Article by J. O. Scott, the Oil and Gas Journal, Jan. 14, 1957, pp. 91-107, 166-308.

*Society of Petroleum Engineers Journal,* "Changes in Earth Stresses Around a Wellbore Caused by Radially Symmetrical Pressure and Temperature Gradients" Apr. 1984, T. K. Perkins and J. A. Gonzalez, pp. 129-140.

*Society of Petroleum Engineers Journal,* "The Effect of Thermoelastic Stresses on Injection Well Fracturing" Feb. 1985, T. K. Perkins and J. A. Gonzalez, pp. 78-88.

*Primary Examiner*—Stephen J. Novosad
*Attorney, Agent, or Firm*—Michael E. Martin

[57] ABSTRACT

A method for hydraulic fracturing a subterranean formation region to control the fracture extent in vertical and horizontal directions characterized by the injection of cold liquid into the formation region to precool the region and reduce the stresses in the formation region so that a hydraulic fracture may be propagated at a lower fluid injection pressure. The shape of the cooled region may be controlled by injection of various quantities of leakoff control agent during injection of the cold liquid and extension of the hydraulic fracture may be carried out simultaneously with the cold liquid flooding or by raising the pressure after the flood front has progressed a desired radial extent from the wellbore. The fracturing operation may be completed by injecting a pad of cold liquid with a high concentration of leakoff control agent to seal the fracture face followed by injection of liquid carrying a sufficient quantity of proppant material to maintain the fracture width and conductivity at the desired level.

7 Claims, 2 Drawing Figures

COLD FLUID HYDRAULIC FRACTURING PROCESS FOR MINERAL BEARING FORMATIONS

BACKGROUND OF THE INVENTION

1. Field of the Invention

The present invention pertains to a hydraulic fracturing process for subterranean hydrocarbon producing formations which includes injection of a cold liquid into the formation to reduce the earth stresses and to control the extent of the fracture within the desired mineral producing zone.

2. Background

When a relatively cold fluid, such as water, is injected into a relatively warm subterranean hydrocarbon bearing reservoir an ever increasing region of cooled rock is established around the injection well and results in the reduction in stresses in the rock which may be on the order of several hundred pounds per square inch (psi). This reduction in stresses in the rock matrix may be utilized to extend hydraulic fractures to enhance the recovery of liquid and gaseous hydrocarbon substances present in the formation to be produced.

Discussions of the effects of thermoelastic stresses in earth formations resulting from the injection of relatively cold liquids into relatively warm formations are discussed in papers published by T. K. Perkins and J. A. Gonzalez entitled "Changes in Earth Stresses Around a Wellbore Caused by Radially Symmetrical Pressure and Temperature Gradients", *Society of Petroleum Engineers Journal,* April, 1984, and "The Effect of Thermoelastic Stresses on Injection Well Fracturing", *Society of Petroleum Engineers Journal,* February, 1985. These papers present methods to determine the effect of the injection of large volumes of liquid into a subterranean earth formation and methods for calculating the thermoelastic stresses and hydraulic fracturing pressures required to achieve a hydraulic fracture. At least some of the assumptions made in the abovementioned publications can be utilized in dealing with fracturing lightly consolidated formations such as the type found in the West Sak Oil Field in Alaska. It is particularly important in developing fields which have relatively low well productivity as determined by conventional fracturing methods to improve productivity by enhancing the width and size of the fracture without the chance of extending the fracture outside of the mineral bearing formation or zone which is desired to be produced.

Conventional hydraulic fracturing, particularly in lightly consolidated formations, is difficult to control as regards the extent of the fracture. Moreover, in lightly consolidated formations, such as the abovementioned oil field, relatively large quantities of fine solid particles are usually carried with the flowing oil stream being produced. These formation particles are carried into a propped hydraulic fracture and tend to significantly reduce fracture conductivity. To prevent the embedment or saturation of the fracture proppant by these relatively fine particles, smaller sizes of proppant particles might be used. However, the use of smaller proppant particles also requires wider fractures to achieve the fracture conductivity required to make the well completion economical. Under these conditions, the use of conventional hydraulic fracturing processes to achieve wide fractures greatly increases the chance of fracturing beyond the desired formation boundaries.

It is an object of the present invention to improve the productivity of hydrocarbon bearing reservoirs which may be damaged or degraded by uncontrolled hydraulic fractures. It is a further object of the present invention to provide an improved process for hydraulically fracturing a hydrocarbon bearing formation, including formations which are lightly consolidated, so as to increase well productivity. These objects, as well as additional objects obtained by the present invention, will be further appreciated by those skilled in the art.

SUMMARY OF THE INVENTION

The present invention provides an improved process for hydraulic fracturing a subterranean hydrocarbon bearing formation wherein pre-cooling of the formation is obtained to reduce formation stresses and pressures and to provide for a hydraulic fracture which has relatively high conductivity but does not extend outside of the desired zone of a formation to be produced.

In accordance with one aspect of the present invention, a relatively wide and propped formation fracture is obtained by injecting a large volume of cold liquid such as water into the formation to create a region of reduced stress adjacent to a wellbore. When the desired size of the reduced stress region within the formation and the stress condition therein has been achieved, a pad of cold fluid containing a relatively high concentration of leakoff control agent is injected to seal the fracture faces to minimize leakoff of fracturing fluid and proppant bearing fluid.

In accordance with another aspect of the present invention, there is provided an improved hydraulic fracturing process wherein after injection of a relatively large volume of cold fluid to reduce the stresses in a particular formation to be fractured, extension of the fracture is carried to a desired limit, and then a relatively cold or viscous fluid is injected at a relatively high rate and with high proppant concentration to widen and prop the fracture in the widened condition.

The overall process of the invention provides for improved hydrocarbon fluid production from formations which are lightly consolidated, in particular.

Additional superior features and advantages of the present invention will be recognized by those skilled in the art upon reading the detailed description which follows in conjunction with the drawing.

DESCRIPTION OF A PREFERRED EMBODIMENT

Figure 1:
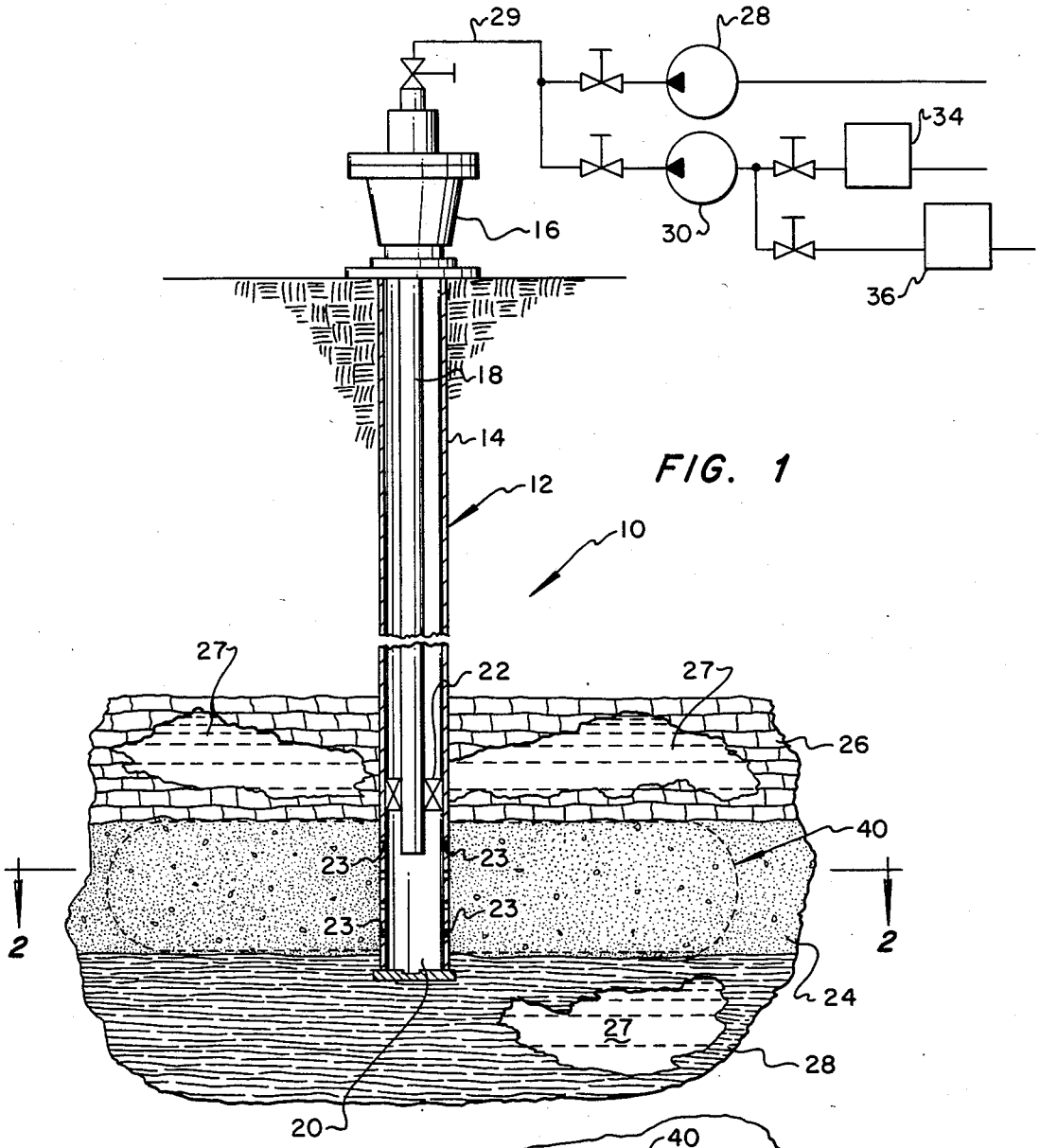
FIG. 1 is a vertical central section view of an earth formation showing in somewhat schematic form an injection well for performing a hydraulic fracture of a desired zone or formation bearing recoverable hydrocarbon fluids.

The drawing figures comprise a somewhat schematic illustration of a typical well completion into a subterranean formation which has been determined to have economically recoverable mineral deposits therein, such as hydrocarbon fluids. Referring to FIG. 1 of the drawing, there is illustrated an earth formation 10 into which a well 12 has been drilled and provided with a suitable casing 14, a conventional wellhead structure 16 and an elongated fluid injection tube 18 extending through the casing. The tube 18 is open into a lower portion of a wellbore 20 which is sealed from the remainder of the wellbore by a packer 22. The casing 14 is provided with suitable perforations 23 which open into a region or zone 24 of the earth formation 10 which has been determined to have recoverable quantities of hydrocarbon fluids, for example. The formation region 24 is bounded by regions 26 above and 28 below, which may or may not be desireable for eventual fracturing to release minerals or fluids contained therein. Typically, for example, a region above or below a produceable formation or region may contain quantities of water or brine 27 which, if the formation region is fractured, would be released to flow into the wellbore 20 through the formation region 24, thereby damaging the producibility of the region 24 or create unwanted separation problems with respect to any fluids produced by the well 12.

For purposes of the discussion herein and by way of illustration, only the well 12 is illustrated as being suitably connected to a source of cold fluids such as treated sea water, not shown, which may be pumped into the tubing 18 by way of a suitable high pressure pump 28 connected to a conduit 29. A second pump 30 may also be connected to the conduit 29 which is in flow communication with the tubing 18. The pump 30 may be selectively connected to a source 34 which includes a leakoff control agent and a source 36 which includes a proppant material. The arrangement illustrated for pumping fluid into the wellbore 20, as shown in FIG. 1, is exemplary and the arrangement of pumping apparatus and sources of material such as leakoff control agents and proppant materials may be modified in one of several ways.

When the well 12 has been drilled and the vertical extent of the formation region 24 determined, perforations 23 are formed in the casing 14 to provide for conduction of fluid between the wellbore 20 and the formation region or zone 24. Depending on the depth of the formation region 24, a significant temperature differential may exist between the temperature of the formation region and the surface ambient temperature, including possibly the temperature of a source of cold fluids such as a nearby lake or ocean. It is, for example, not unusual to experience subterranean hydrocarbon reservoir or formation region temperatures in the range of 150° to 200° F. and greater. Sources of large volumes of "cold" water rarely exceed ambient temperatures higher than 70° to 80° F. The injection fluid can, of course, be artificially refrigerated if desired. Accordingly, a significant temperature differential can exist between the formation being flooded and the temperature of the injection fluid itself. As discussed in the aforementioned publications, significant lowering of formation stresses can be achieved by injecting relatively large volumes of cold fluid into a particular zone or region and, consequently, the pressures required to extend a hydraulic fracture in the region of reduced stress may also be significantly lowered. This reduction in fracture extension pressure can have significant effects on the costs of hydraulic fracturing and can permit greater fracture extension and conductivity thereby resulting in a higher yield of recoverable substances from the fractured formation.

Figure 2:
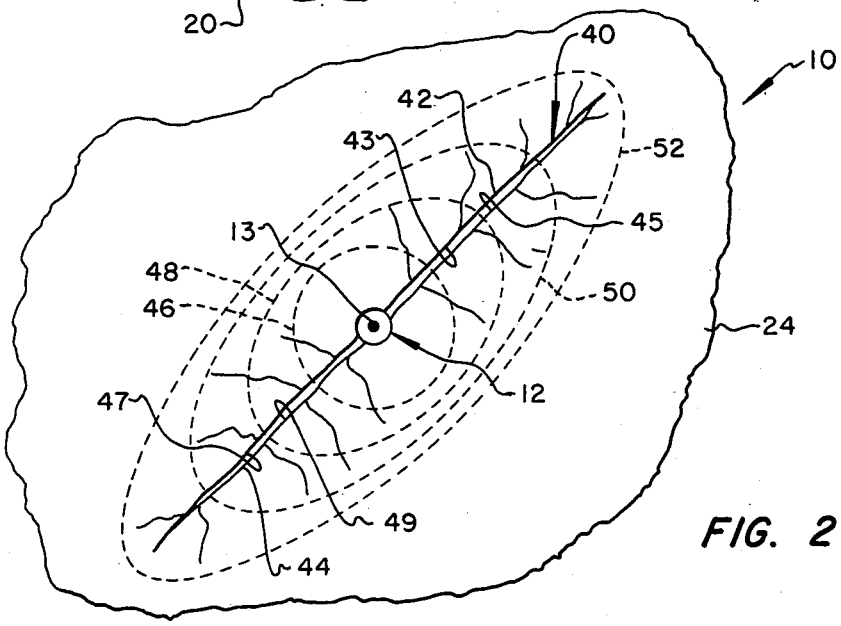
FIG. 2 is a plan view of the injection well and the formation being fractured showing in schematic form the extent of the zones or regions of reduced stress in the formation.

Referring now to FIG. 2 also, there is illustrated in somewhat schematic form the development of a typical fracture radially outwardly from the well 12 within the formation region 24. Since the stresses exerted in the horizontal direction are typically much lower than those in a vertical direction, earth formation fractures induced by hydraulic fracturing, for example, typically extend vertically and propagate perpendicular to the minimum horizontal stress. FIGS. 1 and 2 illustrate an extended fracture, generally designated by the numeral 40 having opposed generally symmetrical wing portions 42 and 44. These fracture wings 42 and 44 extend in an idealized manner generally equally radially outwardly from the central longitudinal axis 13 of the well 12.

FIG. 2 further illustrates the assumed zones of the region 24 for which the temperature of the earth formation has been significantly lowered due to flooding of the formation by a relatively cold liquid such as treated sea water. In a substantially homogeneous earth formation, such as typically is found in unconsolidated sands, it can be assumed that the injected fluid migrates radially outwardly from the well axis 13 uniformly in all directions, thereby forming a generally cylindrical boundary of the cooled region as defined by the dashed line 46 in FIG. 2. Depending on the selected injection rate of formation cooling fluid, the region of cooled rock or earth substance may continue to be defined by a generally cylindrical boundary having its central axis coincident with the wellbore axis 13.

However, due to the significant lowering of stresses in the formation region 24 during injection of the cold fluid in the area that has been cooled, a fracture may be initiated and begin propagating radially outwardly from the well 12. The formation of the fracture 40, for example, as it grows radially will tend to alter the shape of the zone or region of cooled rock to become somewhat elliptical as indicated by the boundary lines 48, 50 and 52. The boundary lines 48, 50 and 52 show the progressive growth in the area of the cooled region, as viewed in the horizontal plane, as the opposed ends of the fracture 40 extend radially outwardly.

Thus, at least two fracture forming conditions can exist and may be controlled by design, knowing the formation characteristics of porosity, and the existing temperatures and stresses prior to injection of the cold fluid. If the fluid injection rate is sufficiently low and the injection pressure maintained sufficient to avoid reaching fracture initiation and extension pressures, the flooded region may grow to maintain a generally cylindrical boundary with respect to the well 12. However, this injection rate may be somewhat time consuming and uneconomical. If the injection rate or pressures are increased above the calculated horizontal stress in the region being cooled, a vertical two-winged fracture will likely be initiated and propagated radially outwardly to change the shape of the cooled region from one having a generally cylindrical boundary to the generally elliptical boundaries indicated by the boundary lines 48, 50 and 52 as the fracture extends radially away from the well.

One major advantage of initiating a fracture by precooling the formation region to be fractured is that control over the fracture extension in a vertical direction as well as the horizontal direction may be enhanced. In the arrangement illustrated, for example, it may be highly desired to avoid extending the fracture 40 into either the region 26 or 28. Since it can be reasonably assumed that injection of cold liquid into the region 24 will be confined vertically to this region and not extend substantially vertically above or below the perforations 23, then fluid injection pressures into the formation 24 may be controlled to avoid the possibility of extending the fracture vertically into either the regions 26 or 28. In this way the fracture 40 avoids breaking into areas in which large quantities of water or other fluids are disposed and which are not desireable to be produced through the well 12.

Accordingly, the fracturing process of the present invention is initiated, upon completion of the well 12, and determination of the physical properties of the formation region 24, by commencing the injection of relatively cold liquid such as water through the conduit 18 and the perforations 23 into the formation region 24 at a controlled rate so as not to exceed the maximum hydraulic fracture extension pressure desired. Depending on formation characteristics, the injection rate may be relatively slow so as to essentially waterflood a generally cylindrical region, or the injection rate may be increased to the hydraulic fracture extension pressure of the cooled region so that the outer limits of the flooded portions of the region 24 tend to become elliptical. The extent of the ellipse defining the boundary of the cooled region with respect to the length of the minor axis may be selectively controlled by injecting a leakoff control agent into the cold injection liquid to partially seal the fracture faces.

Typical leakoff control agents could include vegetable gums or quartz flour, for example, or other conventional leakoff control agents depending on the type of formation structure being fractured. If, for example, the overall length of the fracture 40 radially away from the axis 13 was to be extended to a certain limit and the amount of injection fluid minimized, increasing amounts of leakoff control agent could be mixed with the injection liquid to prevent or reduce the migration of fluid generally normal to the plane of the fracture 40 itself, thereby reducing the length of the minor axes of the elliptical boundaries 48, 50 and 52. Accordingly, two discrete steps according to the improved process may be initially performed upon completion of the well 12. For example, cold liquid may be injected into the formation region 24 at a rate which will maintain pressures lower than the reduced stress in the region resulting from cooling of the formation rock so that the boundary of cooled rock grows substantially radially outward to maintain a generally cylindrical shape. Alternatively, at some point in the injection process, the pressure may be increased to a value which will initiate the fracture 40 and the radial extent of the fracture may be controlled by the injection rate and pressure or by introduction of a leakoff control agent into the injected fluid to at least partially seal the faces of the fracture wings 42 and 44, which faces are designated in FIG. 2 by the numerals 43, 45, 47 and 49, respectively.

After the radial extent of the fracture 40 has been carried to its desired length, one or the other of the pumps 28 and 30 is activated to inject a pad of cold fluid into the fracture 40, which fluid contains a significantly higher concentration of leakoff control agent than previously used in the fracturing process. This pad of cold fluid is injected without reducing the pressure in the lower portion of the wellbore 20 and in the fracture 40 to thereby prevent closing the fracture. The introduction of the pad of cold fluid with the high concentration of leakoff control agent and sealing of the fracture face is carried out to minimize the quantity of injected fluid required to maintain the fracture propped open until the injection of a suitable proppant can be initiated. Accordingly, following the injection of the pad of cold fluid containing leakoff control agent, and without reducing the fracture extension pressure, a second injection process would be initiated immediately using the pump 30 and the source of proppant 34 by injecting a cold or relatively viscous fluid at a relatively high rate and with a relatively high concentration of proppant material, preferably in a proppant size range which would maintain the fracture propped open to the desired width without significantly reducing fracture conductivity.

After injection of the propant material in sufficient quantity to fill the fracture wings 42 and 44, the fluid pressure in the wellbore 20 and the formation region 24 could be relieved to permit the flow of recoverable mineral fluids toward the wellbore.

Thanks to the overall process of fracturing the formation region 24 by initially cooling the region within an envelope which extends radially outwardly from the well 12, hydraulic fractures may be extended within the region without extending the fracture into undesired portions of the earth formation 10 such as the regions 26 and 28 above or below the region which is desired to be produced. In like manner, the horizontal and vertical extent of the fracture may also be controlled through the process of preflooding of the region 24 with cold fluid at a rate which would significantly cool the region without initiating a fracture, or at some point in the injecting and cooling process selectively raising the injection pressure to exceed the horizontal stress to thereby initiate a fracture. By measuring the quantity of injected fluid during the precooling or fracture initiation process, the radial outward extent of the fracture may be controlled and to a great extent the formation region 24 may be controllably fractured without extending the fracture into an area generally outside the vertical confines of the region 24 which it may be desirable to avoid.

Although a preferred embodiment of an improved hydraulic fracturing method has been described herein, those skilled in the art will recognize that various substitutions and modifications to the basic method or process may be made without departing from the scope and spirit of the invention as recited in the appended claims. The physical characteristics of the formation region 24 may be determined in accordance with conventional methods known to those skilled in the art and the calculations required to determine the fracture extension pressure and other injection conditions may be obtained in accordance with the teaching of the publications referenced hereinabove.

What I claim is:

1. A method for hydraulically fracturing a subterranean formation region to stimulate the production of recoverable fluids therefrom comprising the steps of:

providing a wellbore extending into said formation region and means for conducting fluid between said wellbore and said formation region;

injecting a relatively cold liquid into said formation region through said wellbore at a rate which will result in substantial cooling of the formation region below the nominal preinjection temperature of said formation region so as to lower the stresses exerted within the formation region;

increasing the pressure of said cold liquid being injected at a predetermined time after commencing injection of said cold liquid to a value which will initiate a fracture in the cooled portion of said formation region;

injecting a leakoff control agent with said cold liquid in sufficient amounts to provide further flooding of said formation region but to control the shape of the flood front progressing outward from said fracture; and injecting liquid into said fracture containing a quantity of proppant material for maintaining said fracture in a propped open condition upon release of pressure in said wellbore and said formation region due to said injected liquid.

2. The method set forth in claim 1 wherein:

the step of injecting said leakoff control agent with said cold liquid is carried out during extension of said fracture by increasing the injection rate of said cold liquid.

3. The method set forth in claim 1, including the step of:

injecting cold liquid containing a relatively high concentration of leakoff control agent into said fracture after the formation thereof to seal the faces of said fracture.

4. The method set forth in claim 3 wherein:

the step of injecting liquid containing proppant material into said fracture is carried out after the injection of liquid containing said high concentration of leakoff control agent and while maintaining pressure in said fracture sufficient to prop said fracture open.

5. A method for hydraulically fracturing a subterranean formation region to stimulate the production of recoverable fluids therefrom, comprising the steps of:

providing a wellbore extending into said formation region and means for conducting fluid between said wellbore and said formation regions;

injecting a relatively cold liquid into said formation region through said wellbore at a rate such that the pressure of the fluid being injected into the formation region is sufficient to fracture the formation region as the formation region is cooled below its preinjection temperature, and so that the outer limits of the flooded portion of the formation region are defined by a generally elliptical boundary;

injecting selected amounts of leakoff control agent with said injection liquid to at least partially seal the faces of said fracture to control the ellipticity of the boundaries of said cooled portion of said formation region and increasing the amount of leakoff control agent injected with said injection liquid to reduce the migration of injection fluid generally normally to the planes of said fracture;

sealing the faces of said fracture by injecting liquid having a significantly higher concentration of leakoff control agent; and injecting fluid at a relatively high rate and with a relatively high concentration of proppant material having a proppant size range sufficient as to maintain the fracture propped open to a predetermined width without significantly reducing fracture conductivity.

6. A method for hydraulically fracturing a subterranean formation region to control the vertical and horizontal extent of the fracture and to stimulate the production of recoverable fluids therefrom comprising the steps of:

providing a wellbore extending into said formation region and means for conducting fluid between said wellbore and said formation region;

injecting a relatively cold liquid into said formation region through said wellbore at a rate which will result in substantial cooling of said formation region below the nominal preinjection temperature of said formation region so as to lower the stresses exerted within said formation region;

increasing the pressure of the cold liquid during injection thereof to initiate a fracture simultaneously with the injection of cold liquid into said formation region so that said fracture is propagated radially outwardly from said wellbore coincident with the reduction in temperature and stresses in the flooded portion of said formation region;

injecting a leakoff control agent with said cold liquid in sufficient amounts to provide further flooding of said formation region but to control the shape of the flood front progressing outward from said fracture; and injecting liquid into said fracture containing a quantity of proppant material for maintaining said fracture in a propped open condition upon release of pressure in said wellbore and said formation region due to said injected liquid.

7. The method set forth in claim 6, including the step of:

injecting cold liquid containing a relatively high concentration of leakoff control agent into said fracture after the formation thereof to seal the faces of said fracture.

* * * * *